US006168250B1

(12) United States Patent
Rogov

(10) Patent No.: US 6,168,250 B1
(45) Date of Patent: Jan. 2, 2001

(54) FLAT PANEL MONITOR MOUNTING ASSEMBLY

(75) Inventor: Vladymir J. Rogov, San Diego, CA (US)

(73) Assignee: ZMicrosystems, San Diego, CA (US)

( * ) Notice: Under 35 U.S.C. 154(b), the term of this patent shall be extended for 0 days.

(21) Appl. No.: 09/113,691

(22) Filed: Jul. 10, 1998

(51) Int. Cl.[7] ..... G09G 5/00

(52) U.S. Cl. ..... 312/294; 312/226; 312/323; 248/922; 248/917

(58) Field of Search ..... 312/323, 302, 312/303, 7.2, 226, 227; 248/917, 918, 919, 922

(56) References Cited

U.S. PATENT DOCUMENTS

| | | | | |
|---|---|---|---|---|
| 806,550 | * | 12/1905 | Marstall | 312/226 |
| 1,999,476 | * | 4/1935 | Pollock | 312/226 |
| 2,576,730 | * | 11/1951 | Thompson | 312/323 X |
| 3,910,659 | | 10/1975 | Peterson . | |
| 4,258,967 | * | 3/1981 | Boudreau | 312/323 X |
| 4,438,458 | * | 3/1984 | Munscher | 248/917 X |
| 5,021,922 | | 6/1991 | Davis et al. . | |
| 5,085,394 | | 2/1992 | Torii . | |
| 5,161,028 | | 11/1992 | Kawata et al. . | |
| 5,173,686 | | 12/1992 | Fujihara . | |
| 5,177,616 | * | 1/1993 | Riday | 248/919 X |
| 5,179,447 | * | 1/1993 | Lain | 248/917 X |
| 5,329,289 | * | 7/1994 | Sakamoto et al. | 248/922 X |
| 5,607,213 | | 3/1997 | Slivon et al. . | |
| 5,651,594 | | 7/1997 | Lechman . | |
| 5,667,179 | * | 9/1997 | Rosen | 248/917 X |
| 5,812,368 | * | 9/1998 | Chen et al. | 248/922 X |

* cited by examiner

*Primary Examiner*—Peter M. Cuomo
*Assistant Examiner*—Stephen Vu
(74) *Attorney, Agent, or Firm*—Stanley A. Becker

(57) ABSTRACT

A flat panel monitor mounting assembly including a frame for holding a monitor including facilities for allowing the monitor to be rotated from a horizontal position to a vertical position. The assembly includes facilities for allowing the monitor to be rotated about an axis perpendicular to the plane of the monitor so that the monitor can be viewed in either a horizontal viewing position or, alternatively a vertical viewing position. The assembly also includes facilities for tilting the flat panel monitor so that the panel can easily be viewed from any position. The assembly also includes facilities for locking the monitor in either the horizontal viewing position or vertical viewing position.

25 Claims, 6 Drawing Sheets

FLAT PANEL MONITOR MOUNTING ASSEMBLY

BACKGROUND OF THE INVENTION

1. Field of the Invention

This invention relates to a flat panel monitor mounting assembly which allows a flat panel monitor of rectangular configuration to be rotated about a plurality of axes so that it can be viewed in an optimal viewing position and fit into a rack or transit case drawer for storage.

2. Description of Related Art

U.S. Pat. No. 5,085,394 discloses a flat display supporting mechanism that allows a flat display to be positioned flat against the keyboard and pivoted upwardly so that it is positioned substantially vertically for viewing.

U.S. Pat. No. 5,021,922 discloses a portable personal computer which has a moveable flat display which is positioned parallel to the front surface of the computer when the display is in the retracted position. A frictional mechanism permits the display to be positioned at any angle.

U.S. Pat. No. 5,173,686 discloses a sliding accommodation type liquid crystal display device which slides in and out with respect to the main body of the device and is rotatable for viewing.

U.S. Pat. 5,161,028 discloses a car mounted video display apparatus wherein a liquid crystal display can slide out of a holding part and be rotated into position for viewing.

U.S. Pat. No. 5,651,594 discloses a work station for use with flat monitors which discloses a flat monitor being inset into the top surface of a station's work platform which has a transparent window therein and can be adjusted for viewing through the transparent window.

U.S. Pat. No. 3,910,659 discloses a reversible overbed table and mirror in which a mirror can be stored flat and tilted upward when the tabletop is moved so that it can be viewed on either side of the tabletop.

U.S. Pat. No. 5,607,213 discloses a sliding drawer tray horizontally in a drawer or rack with its larger sides parallel to the sides of the drawer or rack and having facilities for rotating the flat panel along one axis to a vertical position, rotating the flat panel so that its longer sides are parallel to the ground.

None of the prior art describes an assembly or device that allows a rectangular flat panel monitor to be stored rotated 90° to a viewing position and be tiltable for facilitating viewing. Furthermore, none of the prior art describes rotating a front portion of a drawer about a horizontal axis to minimize space requirements for a monitor.

SUMMARY OF THE INVENTION

The present invention allows a thin flat panel monitor or display to be used in space constrained environments. The monitor is typically an active matrix liquid crystal display preferably having a high resolution. The monitor can be used in conjunction with a rack enclosure, a transit case, or other storage facilities. The advantages of the subject invention include (1) maximum utilization of space; (2) choice of orientation of flat panel monitor, namely either horizontal format viewing position (landscape), or vertical format viewing position (portrait); (3) good shock and vibration absorbency; and (4) modularity of rotation hub design.

The subject invention includes a mechanism which permits a flat panel monitor to be rotated about an axis parallel to the plane of the monitor from a stored flat or horizontal position within a drawer to an upright and vertical position. The assembly includes facilities for rotating the flat panel monitor about an axis perpendicular to the plane of the panel so that the panel can be viewed in either its normal horizontal format viewing position or alternatively, a vertical format viewing position. The assembly also includes facilities for tilting the flat panel monitor after rotation about the perpendicular axis so that the panel can be easily viewed from any position.

The flat panel monitor assembly is mounted so that it is recessed in a drawer of a rack or transit case so that the drawer can be pushed in and the monitor stored when not in use, and be pulled out and locked into viewing position when the monitor needs to be utilized.

Further aspects of this invention will become apparent from the following detailed description when considered in conjunction with the accompanying drawings. It should be understood, however, that the detailed description in the specific examples all representing the preferred embodiment are given by way of illustration only.

DETAILED DESCRIPTION OF THE PREFERRED EMBODIMENTS

The following description is of the best presently contemplated modes of carrying out the invention. This description is made for the purpose of illustrating the general principles of the invention and should not be taken in a limiting sense.

Figure 1:
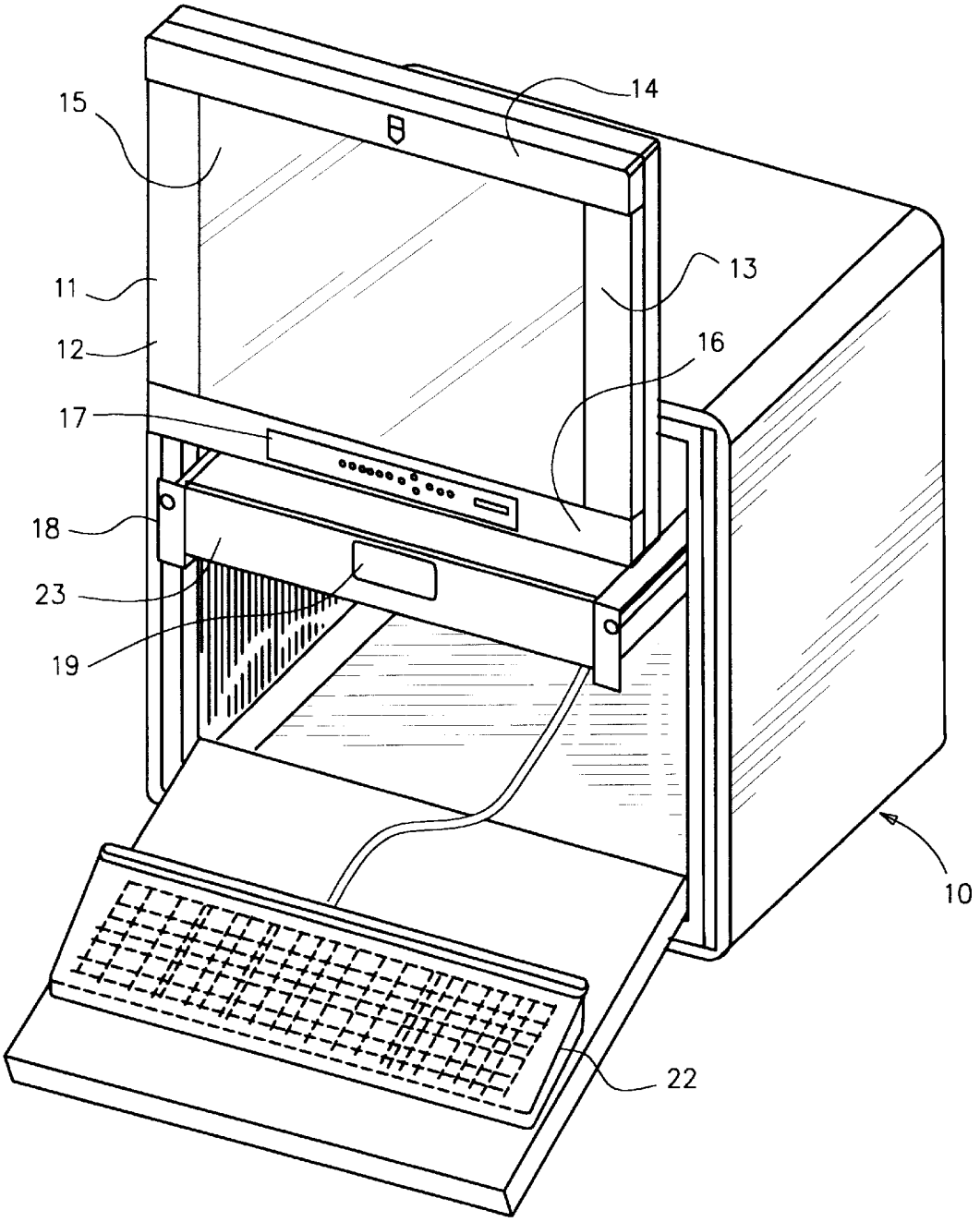
FIG. 1 is a perspective view of a transit case illustrating the flat panel monitor mounting assembly in accordance with this invention.

In accordance with the present invention there is shown in FIG. 1 a standard transit case generally designed as 10. The transit case, or alternatively, a rack assembly typically has a particular height which is designed in "U's". A "U" is approximately 1¾ inches. A typical CRT monitor takes up 11 "U's". A flat panel monitor used in accordance with the subject invention will fit in a two "U" space. Not only is considerable space saved by the utilization of this invention, but improved performance can be had with state of the art flat panel monitors. Also, the monitors can be positioned in any desired orientation to facilitate viewing by the operator. Consequently, if the operator is sitting low, the screen can be tilted toward him so that he can easily see it. If the operator is positioned at eye level or higher, the screen can be vertical or tilted back for easy visibility. Likewise, the display can be rotated 90° if a portrait or vertical view format viewing position is desired as opposed to a horizontal format viewing or landscape view.

Figure 4:
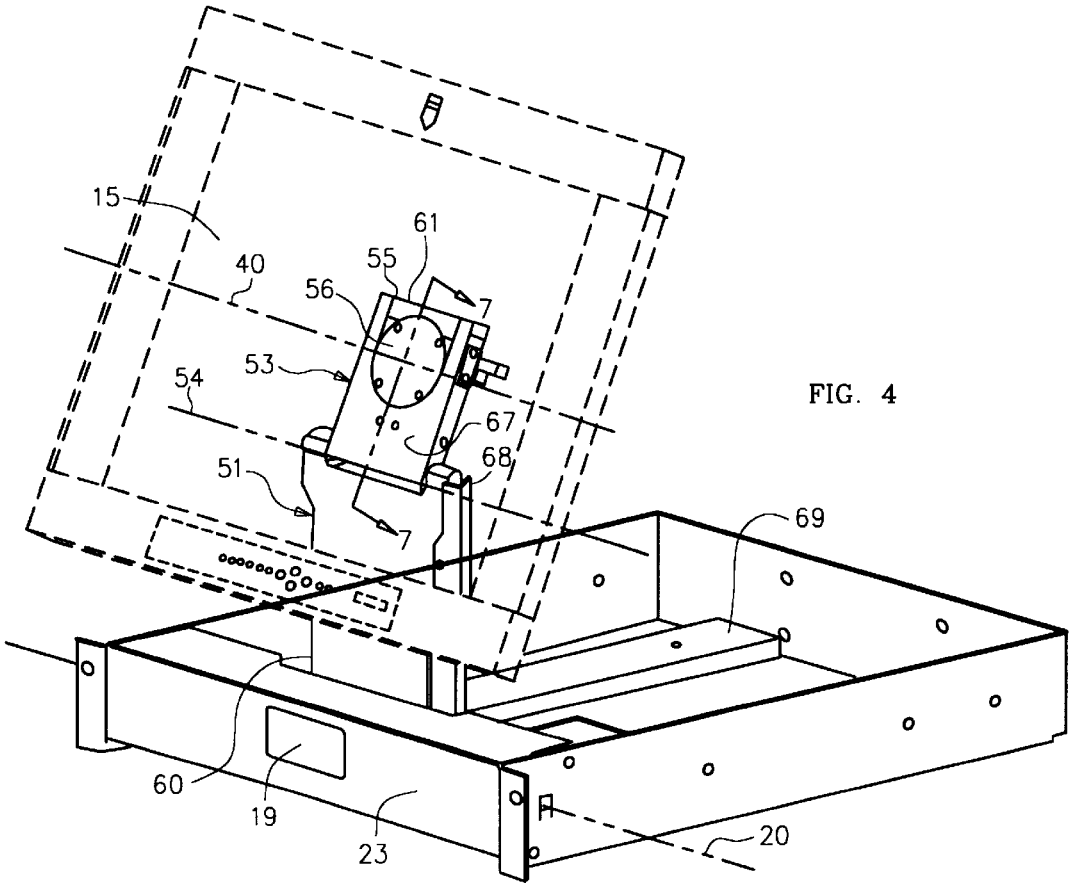
FIG. 4 is a perspective view of the drawer and the flat panel monitor illustrating the monitor (in phantom) being tilted away from the vertical axis and further illustrating the tilting mechanism and the hub rotation assembly for the monitor.

In accordance with the present invention, there is shown in FIGS. 1 and 4 a flat panel monitor 15 mounted within a frame generally designated as 11. The frame 11 consists of side portions 12 and 13 and top and bottom portions 14 and 16. The bottom portion 16 of the frame 11, or the side or top portions, may have a control panel 17 mounted therein. While the frame is shown with separate top, side and bottom portions, it could if desired be one piece. The frame 11 is mounted to a drawer 18 which has a latch mechanism 19. The drawer 18 slides in and out of transit case 10 or rack (not shown) as the case may be. A keyboard 22 is connected to a CPU (not shown) which is also connected to the flat panel monitor 15.

Figure 2:
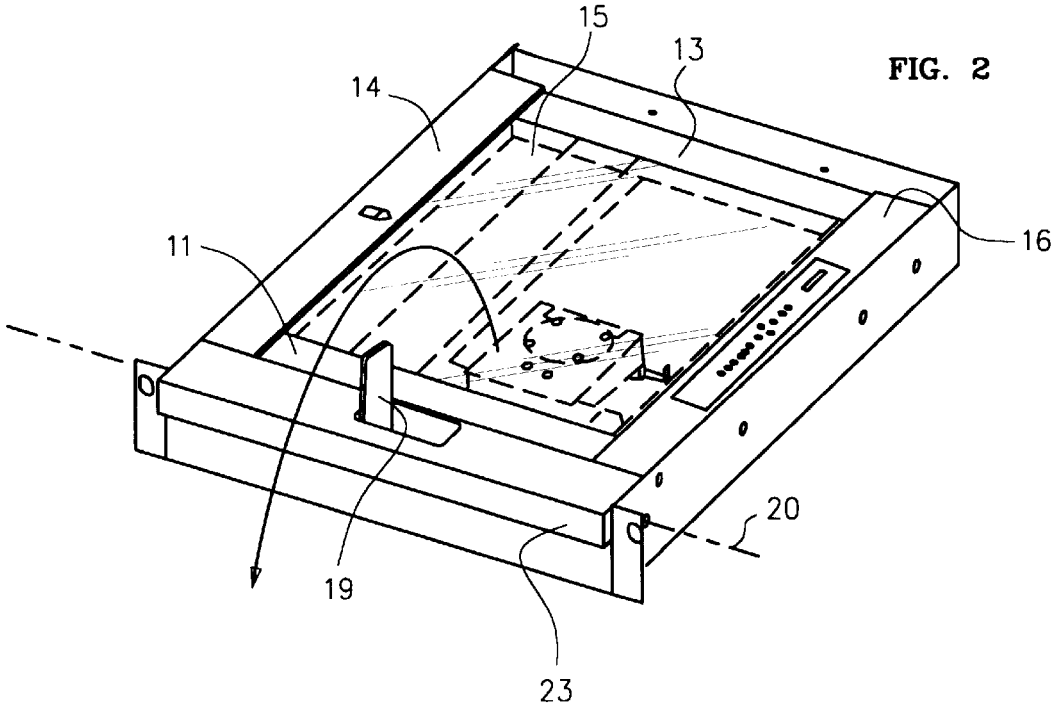
FIG. 2 is a perspective view of a drawer of a transit case or rack with the flat panel monitor in its stored position recessed within the drawer.

Referring to FIG. 2, the monitor 15 is shown in its recessed or stored position within the drawer 18. The latch 19 is preferably recessed into a front assembly 23 of the drawer 18. In use, one end of the latch is pushed in and the latch 19 is rotated 90° to unlock and rotate the front assembly 23 of the drawer 18, as more fully described hereinafter. The drawer 18 of the transit case or rack has been designed in accordance with the principles of this invention to mount within the conventional slides and configuration of the transit case or rack. The front assembly 23 of the drawer 18 rotates about a first axis 20 parallel to the plane of the flat panel monitor 15 from a first position where the latch 19 is on top of the drawer 18 and the flat panel monitor 15 is in a horizontal position within the drawer 18, to a second position where the latch 19 is at the front of the drawer 18 and the monitor 15 is in a vertical position.

Figure 3:
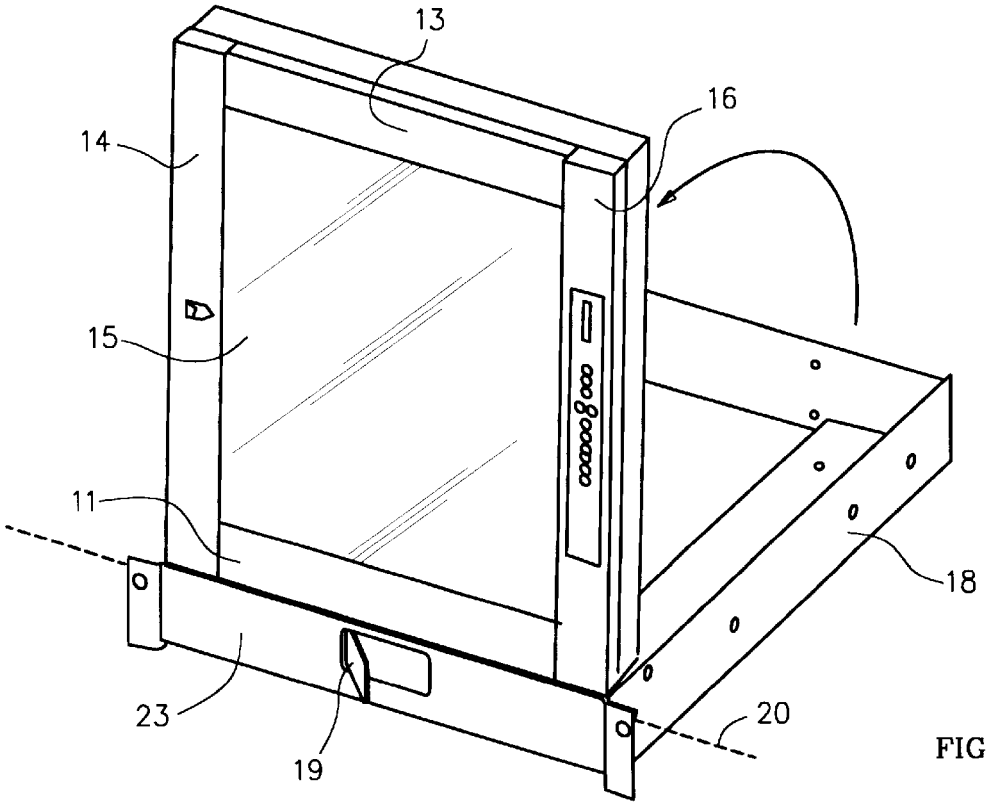
FIG. 3 is a perspective view of the drawer and the flat panel monitor with the front assembly of the drawer rotated 90° so that the monitor is vertical.

Referring to FIG. 3, the flat panel monitor 15 is shown in a vertical position which was achieved by rotating the front assembly 23 90° to move the panel into the vertical position. It can be seen that the latch 19 is now in the front of the drawer 18 as opposed to being on top as shown in FIG. 2.

Figure 5:
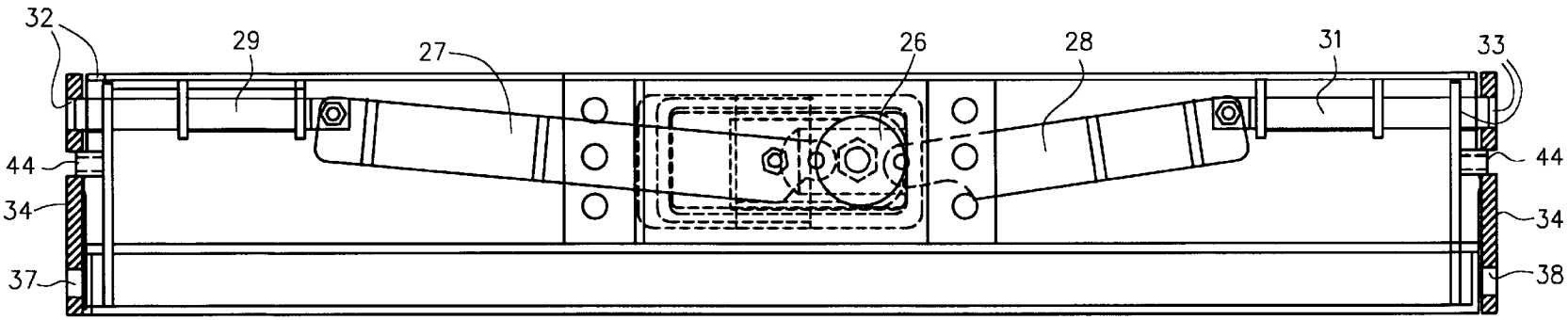
FIG. 5 is a rear view of the mechanism for rotating the front assembly of the drawer.

Referring to FIGS. 4 and 5, rotation of the latch 19 rotates a plate 26 connected to arms 27 and 28 which pulls arms 27 and 28 inwardly to pull pins 29 and 31, which are attached to the outward ends of the arms, inwardly. In the locked viewing position which is shown, the pins 29 and 31 extend through a hole 32 and 33 respectively in the walls 34 and 36 of the drawer 18. By rotating the latch 19, the pins 29 and 31 can be disengaged from the drawer 18 to allow the front assembly 23 to be rotated 90°. This rotation permits maximum clearance for the monitor 10 to be rotated from its vertical viewing position to its horizontal stored position. When the front assembly 23 is rotated 90°, another set of holes 37 and 38 are positioned opposite the ends of the pins 29 and 30 and rotation of the latch 19 back to its original position allows the pins to enter the holes 37 and 38 to lock the front assembly 23 in its horizontal stored position.

Figure 6:
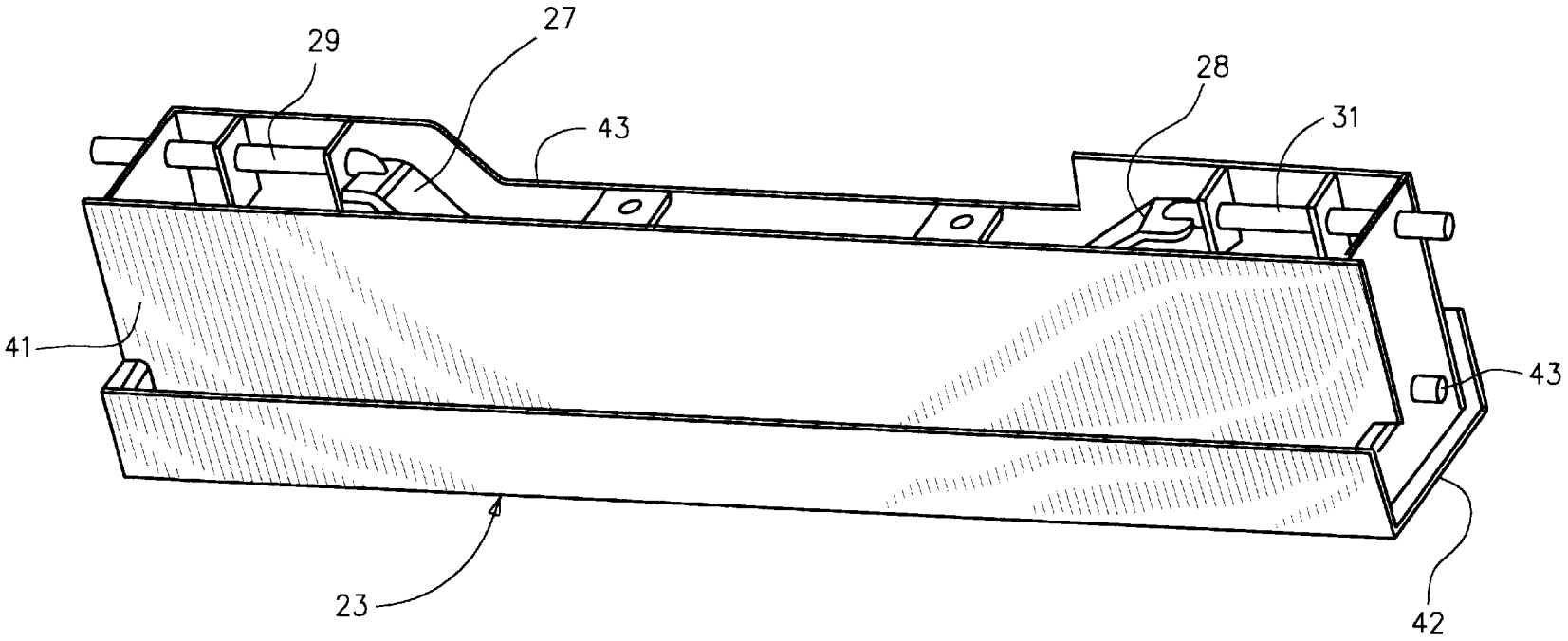
FIG. 6 is a perspective view of the front assembly of the drawer.

Referring to FIG. 6, the front assembly 23 has a substantially "U" shaped cross section having a front wall 41, a top wall 42 and a back wall 43. The arms 27 and 28 are connected to the inward ends of the pins 29 and 31. The entire front assembly 23 rotates about the first axis 20 which results from a pair of pivots or shafts 43 and 44 on each side of the assembly 23. When the monitor 10 is positioned in its vertical position, the pins 29 and 31 are positioned in the upper holes 32 and 33 in the side walls 34 and 36 of the drawer 18. When the monitor 10 is rotated down into its horizontal or stored position, the latch 19 is rotated to the left to pull the pins 29 and 31 inwardly out of the holes 32 and 33 to allow the entire front assembly 23 to be rotated 90°. Upon rotation the pins 29 and 31 are positioned opposite the holes 37 and 38 in the side walls 34 and 36 of the drawer 18. Upon rotating the latch to the right the pins 29 and 32 enter the holes 37 and 38 to lock the flat panel monitor in its horizontal stored position.

Figure 7:
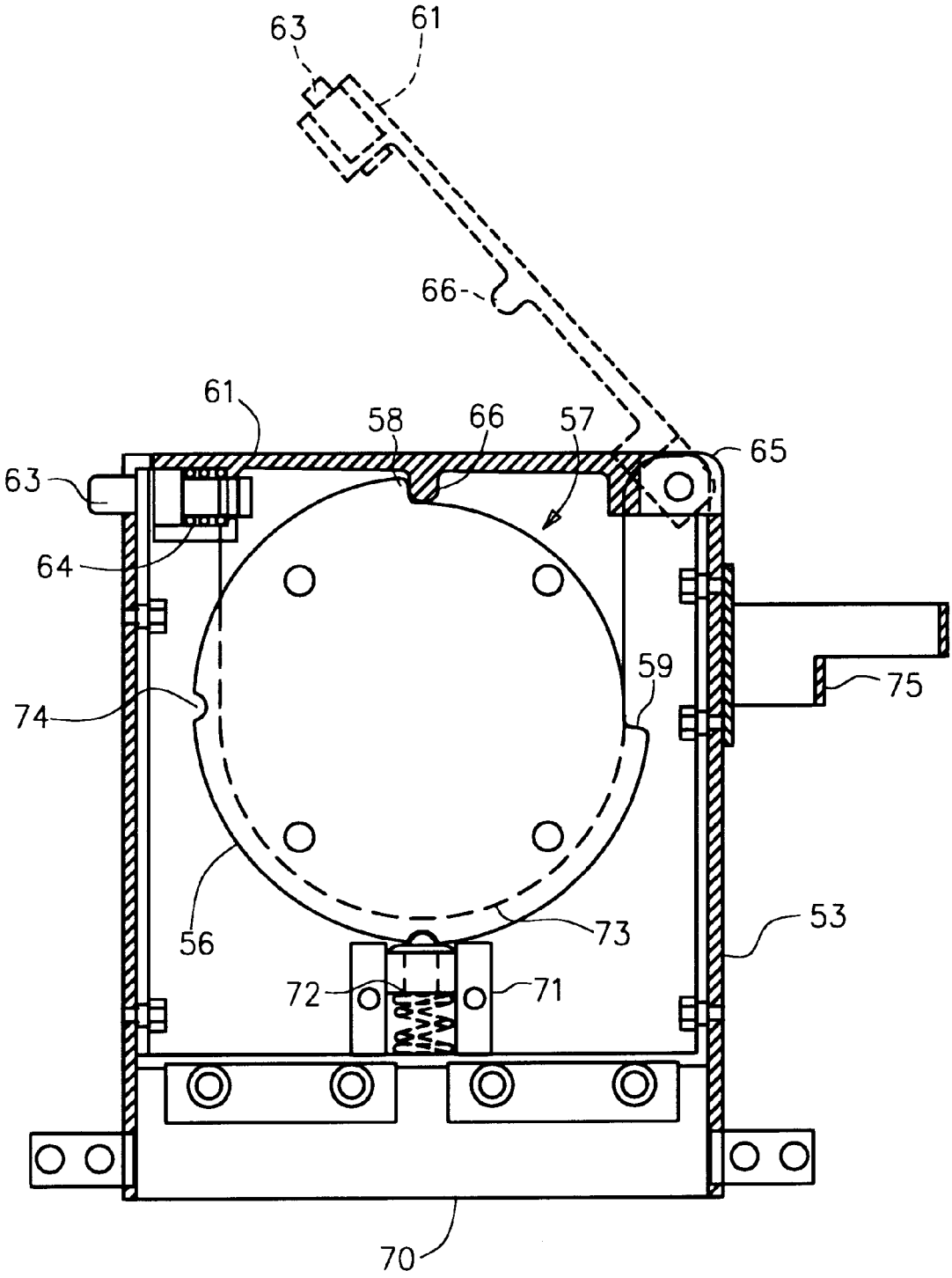
FIG. 7 is an enlarged cross-sectional view of the rotation hub assembly which allows rotation of the monitor from a horizontal format viewing position to a vertical position taken along line 7—7 of FIG. 4.

Referring again to FIGS. 4 and 7, there is shown a support assembly generally designed as 51 which has its lower end 60 connected to the back of the front assembly 23. The support assembly 51 rotates about the first axis 20 with the front assembly 23 as it moves from one position to another as previously described. The upper end of the support assembly 51 is connected to a monitor mounting assembly 53 which has a rotatable hub 56 which in turn is connected to the back of the flat panel monitor 15. The rotatable hub 56 is mounted for rotational movement about a second axis 40 which is perpendicular to the plane of the monitor 15. This allows rotation of the monitor 15 at least 90° from a vertical format viewing position to a horizontal format viewing position. The hub could be rotatable 360° or some portion thereof is desired. The monitor mounting assembly 53 has its lower end mounted from rotational movement about a third axis 54 at the top of support assembly 51. This allows the monitor to be tilted with the top portion of the frame moving back and the bottom portion of the frame moving forward for someone seated level with or above the monitor. If someone is seated below the monitor, the panel can be tilted in the opposite direction. A "U" shaped frame 67 supports the hub 56 for rotation. The frame 67 includes a top member 61 which is hinged at 55. A spring loaded latch 62 is mounted at the other end of the top member 61. The top member 61 is opened by depressing the latch button 63 against spring 64 to allow member 61 to be lifted. This allows the hub 56 and monitor 15 to be removed from the frame 67. As shown in FIG. 7, the hub 56 has a peripheral recess 57 formed therein between projections 58 and 59. This recess allows rotation of the hub 57 from one position where projection 58 engages a projection 66 formed in top member 61 to the other position where projection 59 engages the projection 66.

The bottom 70 of the frame 53 supporting the hub 56 has a unit 71 mounted thereto in which a spring loaded ball 72 is urged into engagement with one of a plurality of detents 73 and 74 formed in the hub 56. When the hub 56 is rotated so that the projection 58 engages projection 66, the ball 72 engages the detent 73 to keep the hub 56 in that position. When the hub and monitor are manually turned counterclockwise until the projection 59 engages projection 66, the ball 72 fits within detent 74 to secure the hub and monitor in that position. The vertical support 51 also has a channel member 68 attached to one side thereof for receiving electrical cable or cables for connecting the monitor 15 to a CPU. The cables are preferably routed from the monitor, through cord guide 75 in the monitor mounting assembly 53, through the channel member 68 and then through a shrouded portion 69 in the drawer for protection of the cables.

Although the present invention has been described in terms of certain preferred embodiments and exemplified with respect thereto, one skilled in the art will readily appreciate the various modifications, changes, omissions and substitutions may be made without departing from the spirit and scope thereof. It is intended that the present invention be limited solely by the scope of the following claims:

What is claimed is:

1. A flat panel monitor mounting assembly comprising:

a frame for holding a flat panel monitor, said frame defining a first plane;

means for rotating said frame and monitor about a first axis parallel to said first plane so that said monitor is in either a first substantially horizontal position or a second substantial vertical position;

means for locking said first axis rotating means when said frame and monitor are in a substantially vertical position; and means for rotating said frame and monitor about a second axis perpendicular to said first plane.

2. A flat panel monitor mounting assembly as set forth in claim 1 comprising:

means for rotating said frame and monitor about a third axis parallel to said first plane and spaced from said first axis to allow said monitor to be adjusted for optimum viewing.

3. A flat panel monitor mounting assembly as set forth in claim 1 comprising means for locking said first axis rotating means when said frame and monitor are in a substantially horizontal position.

4. A flat panel monitor mounting assembly as set forth in claim 1 including means for locking said second axis rotating means with the monitor in at least one position.

5. A flat panel monitor mounting assembly as set forth in claim 1 including means for locking said second axis rotating means with the monitor in either its vertical format viewing position or its horizontal format viewing position.

6. A flat panel monitor assembly as set forth in claim 1 wherein said second axis rotating means comprises a rotatable hub adapted to be mounted to the back of said monitor.

7. A flat panel monitor assembly as set forth in claim 6 comprising:

means for releasing said hub from said second axis rotating means.

8. A flat panel monitor mounting assembly as set forth in claim 6 wherein said hub is rotatable from a first position wherein said monitor is in said vertical format viewing position to a second position wherein said monitor is in said horizontal format viewing position.

9. A flat panel monitor mounting assembly as set forth in claim 8 wherein said hub assembly comprises means for locking said monitor in either of said first or second positions.

10. A flat panel monitor mounting assembly as set forth in claim 1 wherein said means for rotating said frame and monitor about a first axis comprises a drawer for receiving said frame and monitor.

11. A flat panel monitor mounting assembly as set forth in claim 10 wherein said drawer comprises a front drawer portion which is rotatable with respect to said drawer from a first position to a second position, said front drawer portion connected to said frame and monitor.

12. A flat panel monitor mounting assembly as set forth in claim 1 comprising a control panel for said monitor mounted within said frame.

13. A flat panel mounting assembly for mounting in a rack assembly comprising:

a drawer having a width, length and depth for sliding into a rack assembly;

a frame for receiving a flat panel monitor, said frame having two opposed sides of a first dimension smaller than the width of said drawer and two opposed sides of a second dimension larger than the width of said drawer and smaller than the length of said drawer;

means connected to said drawer for rotating said frame about a first horizontal axis adjacent to and parallel to the front of said drawer so that said panel fits within the drawer in a first stored position and is substantially vertical in a second viewing position; and means for locking said first horizontal axis rotating means when said frame and monitor are in a substantially vertical position.

14. A flat panel monitor mounting assembly as set forth in claim 13 comprising:

means for rotating said frame about a second axis perpendicular to said first plane.

15. A flat panel monitor assembly as set forth in claim 13 comprising means for locking said first axis rotating means when said frame and monitor are in a substantially horizontal position.

16. A flat panel monitor mounting assembly as set forth in claim 13 comprising a control panel for said monitor mounted within said frame.

17. A flat panel monitor mounting assembly as set forth in claim 14 comprising:

means for rotating said frame about a third axis parallel to and spaced from said first axis.

18. A flat panel monitor mounting assembly as set froth in claim 14 including means for locking said second axis rotating means with the monitor in either its vertical format viewing position or its horizontal format viewing position.

19. A flat panel monitor assembly as set forth in claim 14 wherein said second axis rotating means comprising a rotatable hub adapted to be mounted to the back of said monitor.

20. A flat panel monitor mounting assembly as set forth in claim 19 wherein said hub is rotatable from a first position wherein said monitor is in its vertical format viewing position to a second position wherein said monitor is in its horizontal format viewing position.

21. A flat panel monitor assembly as set froth in claim 19 comprising:

means for releasing said hub from said second axis rotating means.

22. A flat panel monitor mounting assembly as set forth in claim 20 wherein said hub assembly comprises means for locking said monitor in either of said first or second positions.

23. A flat panel monitor mounting assembly as set forth in claim 13 wherein said second axis rotating means comprises:

a hub assembly having a rotatable hub therein adapted to be connected to the back of said monitor; and wherein said third axis rotating means comprises a support member having one end hinged to said hub assembly and the other end connected to said front drawer portion.

24. A flat panel monitor mounting assembly as set forth in claim 23 wherein said hinged connection of said support member to said hub assembly is a frictional hinge.

25. A flat panel monitor mounting assembly as set forth in claim 23 wherein said drawer comprises a front portion which is connected to said support member and which is rotatable with respect to said drawer from a first position to a second position.

* * * * *